United States Patent [19]

Schultz

[11] 4,106,674

[45] Aug. 15, 1978

[54] PRESSURE-OPERATED CONTAINER FOR VISCOUS PRODUCTS

[76] Inventor: Robert S. Schultz, 7 Heusted Dr., Old Greenwich, Conn. 06870

[21] Appl. No.: 711,681

[22] Filed: Aug. 4, 1976

Related U.S. Application Data

[63] Continuation-in-part of Ser. No. 616,363, Sep. 24, 1975, Pat. No. 4,023,717, which is a continuation-in-part of Ser. No. 459,328, Apr. 9, 1974, abandoned.

[51] Int. Cl.[2] ..... B67D 5/54

[52] U.S. Cl. ..... 222/386.5; 222/389

[58] Field of Search ..... 222/386, 386.5, 389, 222/387; 239/323; 92/246, 247

[56] References Cited

U.S. PATENT DOCUMENTS

| | | | |
|---|---|---|---|
| 2,293,579 | 8/1942 | Vandivier | 222/387 X |
| 3,066,836 | 12/1962 | Trumbull | 222/389 X |
| 3,099,370 | 7/1963 | Hein | 222/386.5 |
| 3,132,570 | 5/1964 | Hoffman et al. | 222/389 X |
| 3,132,774 | 5/1964 | Soffer | 222/402.22 |
| 3,147,753 | 9/1964 | Nogier et al. | 92/247X |
| 3,381,863 | 5/1968 | Towns | 222/389 X |
| 3,745,890 | 7/1973 | Costarella | 92/246 X |

FOREIGN PATENT DOCUMENTS

| | | | |
|---|---|---|---|
| 2,241,924 | 3/1973 | Fed. Rep. of Germany | 222/389 |

*Primary Examiner*—Robert B. Reeves
*Assistant Examiner*—Francis J. Bartuska
*Attorney, Agent, or Firm*—Hopgood, Calimafde, Kalil, Blaustein & Lieberman

[57] ABSTRACT

The invention contemplates a pressurized container for viscous foods or other viscous products in which the body of the piston includes, adjacent the head end, a flexible circumferential band which lightly contacts or is expandable in the presence of loading pressure exerted by propellant gas. The band thus develops light sealing contact with the interior wall surface of the container, and such contact effectively isolates unexpelled product from the gas-pressure side of the piston, regardless of the extent to which product has been expelled. The piston further includes circumferentially continuous tail structure which is connected to and axially spaced from the expandable band and which serves to stabilize the piston against malfunction in the course of its single product-expelling stroke.

18 Claims, 7 Drawing Figures

PRESSURE-OPERATED CONTAINER FOR VISCOUS PRODUCTS

This application is a continuation-in-part of my copending application, Ser. No. 616,363, filed Sept. 24, 1975 now U.S. Pat. No. 4,023,717, which copending application is a continuation-in-part of my earlier application, Ser. No. 459,328, filed Apr. 9, 1974 (now abandoned).

The present invention relates to a pressure-packaging system for viscous products and particularly to a piston construction for a pressurized container.

Highly effective piston valve and container relationships of the character indicated are disclosed in my application Ser. No. 290,977 (now U.S. Pat. No. 3,827,607, issued Aug. 6, 1974). In said patent, the piston is characterized by a resilient flange member, spaced from the tubular body of the piston and responsive to pressure-loading, to maintain a light sealing pressure on the interior wall surface of the container. This construction, although effective, does present some complexity in the molding techniques needed to make each piston as a single integral product of plastic injection molding.

It is, accordingly, an object to provide an improved construction of the character indicated, lending itself to inherently simpler and less costly fabrication.

Another object is to achieve the above object with little or no sacrifice in operating effectiveness.

It is a specific object to produce a simpler piston for achieving smooth discharge flow in a container of the character indicated.

A specific object is to achieve the foregoing objects in a valved pressure container having a piston operable therein in which the viscous product is in the valved end of the container and ahead of the piston while a gas, such as nitrogen, air, etc., is introduced under pressure behind the piston to urge the latter against the product and expel the product through the valved opening.

Another specific object is to provide in such a container a piston and seal construction which permits the piston to operate smoothly within the container in spite of any piston expansion, as may be caused by piston absorption of oils present in the viscous product to be dispensed.

A further specific object is to provide an improved container of the character indicated wherein viscous product may be loaded through the bottom of the container and in direct void-free relation with the valve.

Another specific object is to provide an improved piston construction for a container of the character indicated wherein viscous product is loaded from the top end of the container and against the piston and yet wherein smooth piston action is not adversely affected by the fact of such top loading.

A general object is to achieve the foregoing objects with a construction which inherently uses less material and simplifies container assembly, and which operates smoothly and without piston bind, even if the container has been so abused as to have side-wall indentations.

Other objects and various further features of novelty and invention will be pointed out or will occur to those skilled in the art from a reading of the following specification, in conjunction with the accompanying drawings. In said drawings.

Figure 1:
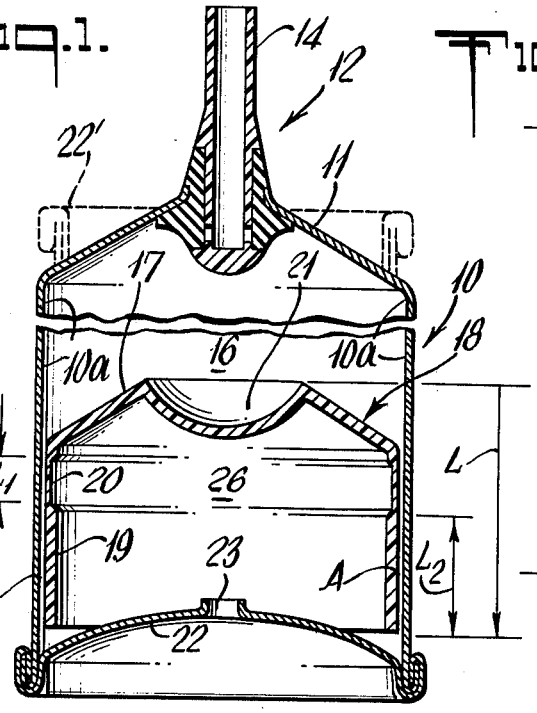
FIG. 1 is a simplified longitudinal sectional view of a container to illustrate a feature of the invention, and shown in unpressurized condition.
Figure 2:
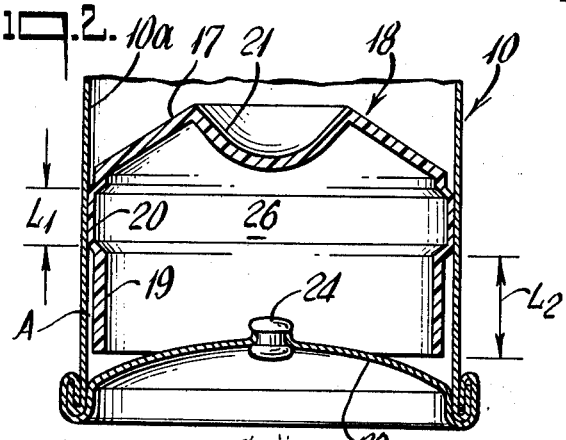
FIG. 2 is a fragmentary view similar to FIG. 1, to show a different parts relationship, under pressurized conditions.

Referring to FIGS. 1 and 2, a pressurized container or can 10 is formed with an integral conical top-end wall 11 and provided with a valve, referred to generally by the reference numeral 12. The valve 12 is of the variety in which a valve stem 14 is pressed laterally in a well-known manner in order to release the valve seal and permit the viscous product 16, which is at super-atmospheric pressure, to be expelled to the atmosphere. It is to be noted that the container and valve per se form no part of the present invention; however, particular cooperating relationships between these are other parts are regarded as inventive.

As described in said copending and earlier applications, a generally tubular hollow piston 18, which may be constituted of a low density polyethylene, a polypropylene material, or any other suitable plastic material, is used to drive product 16 through the dispensing valve 12. Secured to or integral with upper and lower parts 17–19 is a relatively thin and resilient flexible circumferential band 20 of large external surface area and predetermined effective axial length $L_1$, for example 15 to 35 percent, of the overall axial extent L of piston 18. The upper part 17 is conical, in conformance with the conical shape of end wall 11, and is relatively thick and stiff, having a central generally spherical concavity 21 adapted for close fit to the generally convex spherical contour of the dispensing-valve member when product is fully dispensed, conical surfaces 11–17 being then in contact. The lower part 19 is cylindrical and may be viewed as a less flexibly yieldable second circumferential band of predetermined length $L_2$ near the open end of the piston. Generally, the thickness of the flexible band 20 is in the order of 0.005 to 0.015 inch and is less than one half the wall thickness of the less flexible band 19, and the more flexible length $L_1$ approximates but is preferably less than the less flexible length $L_2$.

Stated in other words as to flexibility, the nature and dimensions of the more flexible band 20 are such, in relation to the container wall surface 10*a*, that dependable but light sealing contact is provided with the container wall surface 10*a*, in the presence of propellant-gas pressure within piston 18.

Also, under such pressure, the nature and dimensions of the less flexible band 19 are such that no circumferentially continuous contact thereof is established with wall surface 10*a*.

The container 10 is closed by a bottom wall 22 having a central opening 23 for reception of a sealing grommet 24. Propellant gas 26, such as nitrogen, is introduced via opening 23 after viscous product 16 and piston 18 are inserted into the container, and grommet 24 completes the sealed closure under pressure. If the unstressed clearance A between piston band 20 and container wall 10*a* is small, e.g., zero to 0.010 inch, then rapid application of pressure-gas loading immediately inflates the flexible band into sealing contact with wall 10*a*, squeezing back into the product zone 16 any product which may have entered the clearance; thereafter, surface tension of the product, surface-wetting by the product of adjacent sealing surfaces 10*a*–20, and continued gas-pressure loading all combine to assure maintenance of a sealed relationship and therefore an effective noncontaminating isolation between the product chamber 16 and the gas chamber 26, throughout the life of the container, i.e., as long as product remains to be dispensed. At the same time, by reason of its less flexible property, the lower band 19 remains in clearance relation with wall 10*a*, as suggested at A in FIG. 2, so that the flexible band 20 is the only means of piston suspension in a loaded container.

FIG. 2 also serves to illustrate an embodiment in which, in unstressed condition, the circumferential extent of flexible band 20 is substantially equal to or slightly greater than the peripheral extent of the container wall surface 10*a*, thus establishing very light frictional contact of these parts upon assembly; of course, such circumferential contact is to the exclusion of circumferential contact by the lower and less flexible band 19, as suggested by clearance A, to denote the lesser circumferential extent of band 19.

It is a feature of the indicated structure that, whether band 20 must be inflated for full circumferential contact with the wall surface 10*a*, or whether band 20 is initially formed for such contact in the unpressurized state, it is the band 20 alone which is relied upon (a) for a full circumferential seal between propellant gas and product during any dispensing of the product, and (b) for primary centrally stabilized support of the piston. In the latter connection, it is also important to stability that the bottom limit or tail edge of the band 19 will have limited contact with the wall surface 10*a* and that such limited contact assures against any upset or inversion of the piston in the course of its travel, in spite of dents or other container-wall discontinuities which might otherwise introduce such an off-axis drag asymmetry as to invert the piston and destroy its effectiveness. Stated in other words, the inflatable flexible band 20 maintains its full circumferential sealing qualities in spite of the small angular displacements which may occur between the piston axis and the container-wall axis, i.e., within the stabilizing limits provided by tail-edge contact with the container wall.

Figure 3:
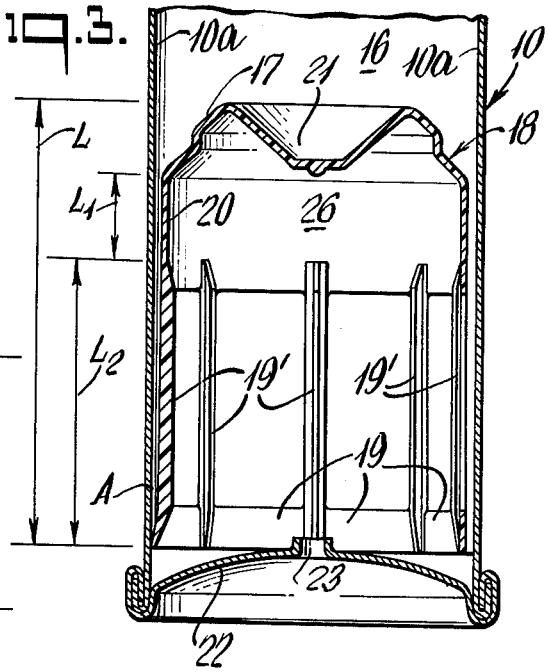
FIG. 3 is a fragmentary view similar to FIG. 1, to illustrate the preferred embodiment.
Figure 4:
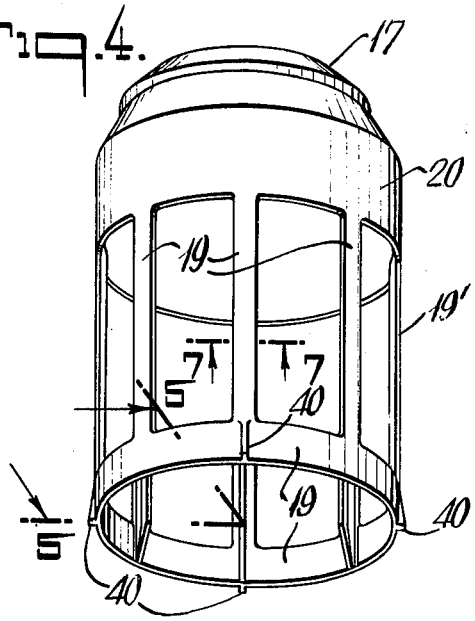
FIG. 4 is a view in perspective showing the piston element which appears in FIG. 3.

FIGS. 3 and 4 illustrate a presently preferred lightweight piston embodiment of my invention, wherein the above-noted circumferential-sealing and central-stabilizing functions of the inflatable resilient band 20 are retained, in the context of a second or stabilizing tail band 19 which is structured essentially only for its stabilizing contact with the container wall. Thus, FIGS. 3 and 4 illustrate that plural angularly spaced longitudinal struts or rib members 19' may form the integral connection between bands 19 and 20, without sacrifice of either of the above-noted important functions.

Quite aside from the saving in piston material and weight, due to absence of piston wall structure between the longitudinal members 19', the piston of FIGS. 3 and 4 will be seen to afford further economies in manufacture, through use of a central molding core which can be accurately held to concentricity with the basic mold cavity, i.e., the core does not require a cantilevered projection into the cavity, as in the case for FIGS. 1 and 2. This feature, which will be explained in greater detail in connection with FIG. 5, will be seen to enable an even more thin (and uniformly thin) piston head 17 and band 20 than in my prior constructions.

Figure 5:
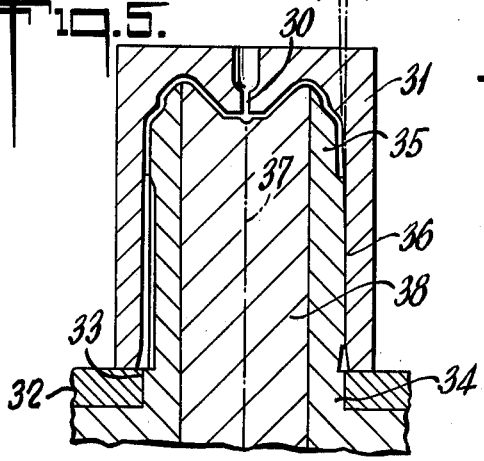
FIG. 5 is a vertical sectional view of the mold structure for fabricating the piston of FIG. 4, the section being taken on the alignment 5–5 of FIG. 4.

In the mold construction of FIG. 5, a piston of the type shown in FIGS. 3 and 4 is basically the product of high-pressure injection-molding via a sprue passage 30 in the closed end of a body member 31 in which the outer-surface contours of the mold cavity are established. A stripper plate 32 has a circular opening 33 for guided positioning of the cylindrical base region 34 of an annular core member 35. Spaced lands 36 of the core derive fitted radially stabilized support from adjacent regions of the cavity wall when the core is axially positioned for a molding injection, as depicted in FIG. 5; preferably a slight taper angle $\alpha$, in the order of two degrees with respect to the central axis 37, characterizes the fitted cavity and core surfaces. Finally, a knock-out plug 38 is longitudinally guided by and positionable with respect to core 35. The mold configuration will be seen to assure precise definition of the thin inflatable-band region which is important to the piston structure described above.

In an illustrative molding operation, the members 31–32–35–37 are clamped in their relative positions shown in FIG. 5. The molding process then proceeds with injection and curing cycles as is customary. To remove the molded product, actuating means (symbolized by an arrow 39) upwardly retracts the mold-cavity member 31, and actuating means (symbolized by an arrow 39') effectively downwardly retracts the core member 35, leaving the molded product supported by and with respect to the knock-out plug 37 and the stripper 32; in actuality, the knock-out plug 37 and stripper ring 32, acting in concert, push the molded piston from the core 35. The undercut rib formations, as at 19', strip easily off the core because of the yieldable nature of the molded-piston material and because of the open spaces between ribs. After product removal, the parts are returned to their FIG. 5 positions, to repeat the cycle.

Figure 6:
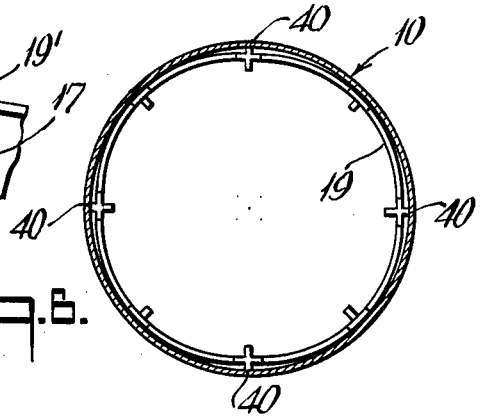
FIG. 6 is a sectional view taken through a lower region of the container of FIG. 3 in order to show in elevation the cooperating functional relationship of tail structure of the piston of FIGS. 3 and 4.

Quite aside from the foregoing considerations as to thin structure, the invention permits of certain desirable features at the tail band region 19. In general, the outside diameter of band 19 is selected so as not to interfere with the container bore diameter, i.e., the circumference of band 19 alone is selected to be less than that of the container bore. On the other hand, it is in some cases desirable to provide local radially outward rib formations 40 at angular spacings about band 19, and the unstressed circle which contains these rib formations may be of greater diameter than the container bore. In such case, ribs 40 will interfere lightly with the bore 10*a* and will cause highly compliant deformation of band 19 into a circumferentially undulating course, depicted with some exaggeration in FIG. 6. It will be appreciated that with a relationship between band 19 and container wall 10*a* as depicted in FIG. 6, all tail-stabilizing wall contact is limited to the spaced rib formations 40, and there is a compliant loading of such contacts, tending to enhance and preserve the noted stabilization feature even when the piston axis and the container axis are strictly concentric.

Figure 7:
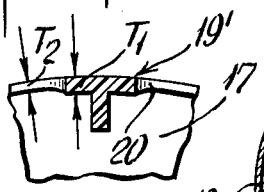
FIG. 7 is an enlarged fragmentary sectional view taken at 7–7 in FIG. 4.

It will be apparent that ribs 19' may be of section appropriate to the necessary tail-spacing and stabilizing functions already noted. For a bottom-loaded container, as closed by the bottom wall 22, the relative stiffness of ribs 19' is not as important as for a top-loaded container, suggested by dashed outline of a chime connection 22' in FIG. 1 for such a top closure carrying the valve means 12. Of course, in a top-loaded configuration, the stiffness of ribs 19' must be adequate to support product during the loading process; however, once loaded and pressurized, the need for such relatively stiff support is reduced. And FIG. 7 illustrates on an enlarged scale a T-shaped rib section which has been found adequate to the task of product support in a top-loading embodiment wherein the viscous product is a caulk for weatherproof seal of building cracks and joints; in FIG. 7, the arms of the rib section are seen to be of thickness $T_1$ approximately double the thickness $T_2$ of the inflatable band 20.

In top-filling applications of the invention, it will be appreciated that the weight of product loaded over the closed end 17 of the piston will first drive the piston skirt 19 into contact with the container bottom and will then so incrementally axially compress and radially outwardly urge the thin resilient band region 20 as to lightly radially load the same into assured circumferentially continuous sealing contact with the container wall. Such contact remains while the top end (with its valve 12) is chimeconnected, to close the top end over the loaded product. And subsequent gas-pressurizing and sealing at 24 merely pressure-loads the band 20 to assure continued large-area contact with the container wall, throughout the dispensable-product life of the container.

The invention will be seen to have achieved all stated objects, with inherent simplicity and economy of parts, their assembly, and their construction. Wedge formations on stabilizing ribs 40 aid removability from the piston wall, and they also assure against any substantial circumferential arc of engagement of the lower end 19 of the piston with the container wall. Further, it will be noted that the space A, which permits easy loading and operation of piston 18 in container 19, functions to provide room for lateral expansion of less flexible piston parts 17–19, especially when oily-type or flavored products are loaded in the container, the expansion of these parts being due to absorption of product oils. With such absorption and expansion, the more resilient band 20 readily adapts by further flattening (i.e., larger-area contact) with the container wall 10*a;* however, light sealing pressure continues to characterize its resilient contact, sealing propellant from product, while permitting piston 18 and product to move smoothly as product is dispensed by valve means 12; the nature of resilient band 20 is to flex in and out of any indentations and over any projecting or other imperfections that might be present on the interior wall surface 10*a.*

In connection with the above-mentioned specific application of the invention to the selective pressurized dispensing of caulk from a cylindrical container, it can be stated that an inflatable-band (20) thickness of 0.012 inch in an injection-molded low-density polyethylene piston of approximately 2-inch diameter has been found to be so self-adapting and self-sealing to wall-surface discontinuities as to permit use of an economically advantageous container 10 of the side-seam variety, as distinguished from the more expensive drawn-type containers which prior pistons have required.

While the invention has been described in detail for the preferred forms shown, it will be understood that modifications may be made without departure from the claimed invention.

What is claimed is:

1. A piston for a pressurized container having a viscous product and provided with a dispensing valve, said piston being a single injection-molded plastic article and comprising a piston body consisting of an end-closing head part and axially spaced first and second tubular parts; said first tubular part including head and tail ends, said head end being circumferentially continuously connected to said head part and further including a relatively thin expandable first circumferential band of predetermined axial length near said head end and adapted to provide, is pressurized assembly to the bore of a cylindrical container, a large continuously smooth pressure-inflated contour-adapting sealing contact with the container bore; said second tubular part including a second band defining a circumferentially continuous open tail of said piston, said second tubular part including plural angularly spaced longitudinal ribs extending continuously from the tail end of said first band to the tail end of said piston, said second tubular part being circumferentially continuous substantially only at the tail end, said second tubular part being open and therefore circumferentially discontinuous between ribs, and said ribs being substantially the only means of connection of circumferentially continuous portions of said first and second tubular parts.

2. A piston for a pressurized container having a viscous product and provided with a dispensing valve, said piston being a single injection-molded plastic article and comprising a piston body consisting of an end-closing head part and axially spaced first and second tubular parts; said first tubular part being circumferentially continuously connected to said head part and comprising a relatively thin expandable first circumferential band of predetermined axial length near said head part and adapted to provide, in pressurized assembly to the bore of a cylindrical container, a large continuously smooth pressure-inflated contour-adapting sealing contact with the container bore; said second tubular part including a second band defining a circumferentially continuous open tail of said piston, said second tubular part including plural angularly spaced longitudinal ribs extending continuously from said first band to the tail end of said piston, said second tubular part including at the tail end a plurality of angularly spaced radially outwardly extending ribs of unstressed radial extent greater than that of said second band.

3. A piston for a pressurized container having a viscous product and provided with a dispensing valve, said piston being a single injection-molded plastic article and comprising a piston body of generally tubular configuration and closed at its upper end and open at its lower end, the tubular portion of said piston body comprising a relatively thin resiliently expandable first circumferential band of large continuously smooth surface area and predetermined axial length near said closed end and adapted to provide, in pressurized assembly to the bore of a cylindrical container, a relatively large continuously smooth pressure-inflated contour-adapting sealing contact with the container bore, said first circumferential band having an upper end connected to the closed end of said piston, said first band also having a lower end, a second circumferential band of predetermined axial length near the open end, and a plurality of angularly spaced legs connecting said second circumferential band to the lower end of said first band, whereby said bands are axially spaced and interconnected by said legs to thereby comprise and define substantially the entire axial length of the tubular portion of said piston body, said piston body being open in the spaces between said legs; whereby, with said piston in a suitable product-loaded container, and when the space beneath the piston is subjected to a predetermined charge of gas under pressure, said first band will be expanded into pressure-loaded peripherally and axially continuous light sealing and stabilizing contact with the container wall and said second band will have stabilizing contact with the container wall.

4. The piston of claim 3, wherein the thickness of said first band is less than half the thickness of said second band.

5. The piston of claim 3, wherein the thickness of said first band is in the range of 0.005 to 0.015 inch.

6. The piston of claim 3, wherein the unstressed condition said first band is characterized by an outer generally cylindrical wall of peripheral extent exceeding that of said second band.

7. The piston of claim 3, in which said second band is integrally formed with plural angularly spaced radially short outward projections for correspondingly spaced stabilizing contact with the container wall.

8. The piston of claim 7, in which each said projection is a longitudinal ridge formation in the outer surface of said second band.

9. The piston of claim 3, in which said ribs project inwardly of the inner wall surface of said second band.

10. In combination, a pressure container comprising an elongate cylindrical body with a closed upper end, dispensing-valve means in said upper end, a one-piece molded piston of resiliently deformable material and integrally including a closed upper head end and a tubular body structure extending downwardly within the cylinder of the container wall and united to the closed end of said piston, said tubular body structure comprising a relatively thin resiliently expandable first circumferential tubular band of large continuously smooth surface area and predetermined axial length circumferentially continuously connected to and near said closed upper end, said first circumferential band having an upper end connected to the closed end of said piston, said first band also having a lower end, a second circumferential band near the open end of said piston, said second band being connected in axially spaced relation to said first band by plural angularly spaced longitudinal members integrally formed with the lower end of said first band and with the upper end of said second band, said tubular body structure being open in the spaces between longitudinal members; a viscous product in the space between said piston and valve means, pressure-sealing means closing the lower end of said container to define a pressure chamber beneath said piston, and a predetermined charge of gas under pressure in the pressure chamber and for pressure-loading said first band into peripheral and axially continuous light sealing and stabilizing contact with the container wall during a product-dispensing operation, said stabilizing contact being aided by second-band contact with the container wall.

11. The combination of claim 10, in which said first band is the only means of circumferentially continuous piston suspension with respect to the container wall.

12. The combination of claim 10, in which said first band has an unstressed external peripheral of substantially the inner wall-surface peripheral extent of the container body, and in which said second band has an unstressed external periphery less than that of said first band.

13. The combination of claim 10, in which said second band has an external periphery which under pressure-loading is less than the inner wall-surface peripheral extent of the container body.

14. The combination of claim 10, in which integral stabilizing skids project from the other surface of said second band in angularly spaced stabilizing-contact relation with the inner wall surface of the container body.

15. The combination of claim 10, in which said container body has a top opening, said dispensing-valve means being assembled to said body at the top opening after dispensable product is loaded through the opening.

16. The combination of claim 10, in which said container body has a bottom opening and a bottom panel for closing the container after said piston is assembled to product loaded through the open bottom of the container.

17. The combination of claim 10, in which said closed upper end of said container includes a conical reduction from said cylindrical body to a central valve-locating opening.

18. The combination of claim 10, wherein the portion of said valve means exposed internally of said container is characterized by a central convex spherical contour, and wherein the upper surface of the closed end of said piston is characterized by a central spherical concavity substantially matching the said convex contour.

* * * * *